US007560065B2

(12) United States Patent
Troitski et al.

(10) Patent No.: US 7,560,065 B2
(45) Date of Patent: Jul. 14, 2009

(54) METHOD AND SYSTEM FOR MANUFACTURING OF MULTI-COMPONENT COMPLEX SHAPE PARTS CONSISTING OF MONOLITHIC AND POWDER MATERIALS WORKING AT DIFFERENT PERFORMANCE CONDITIONS

(76) Inventors: Igor Troitski, 853 Arrowhead Trail, Henderson, NV (US) 89015; Roman Haykin, 6741 Lincoln Ave., 171, Buena Park, CA (US) 90620; Eugene Kratt, 2215 W. Broadway F319, Anaheim, CA (US) 92804; Victor Samarov, 2215 W. Westbroadway F319, Anaheim, CA (US) 92804; Dmitry Seliverstov, 2275 W. Broadway M207, Anaheim, CA (US) 92804; Evgeny Khomiakov, 2275 W. Broadway M207, Anaheim, CA (US) 92804

( * ) Notice: Subject to any disclaimer, the term of this patent is extended or adjusted under 35 U.S.C. 154(b) by 323 days.

(21) Appl. No.: 10/962,147

(22) Filed: Oct. 8, 2004

(65) Prior Publication Data

US 2006/0078455 A1 Apr. 13, 2006

(51) Int. Cl.
*B22F 3/15* (2006.01)
*B22F 5/04* (2006.01)

(52) U.S. Cl. ..... 419/8; 419/29; 419/49

(58) Field of Classification Search ..... 419/8, 419/49, 29

See application file for complete search history.

(56) References Cited

U.S. PATENT DOCUMENTS 4,063,939 A * 12/1977 Weaver et al. ..... 419/5
4,096,615 A * 6/1978 Cross ..... 29/889.21
4,526,747 A * 7/1985 Schimmel et al. ..... 419/8
4,529,452 A 7/1985 Walker ..... 148/527
4,581,300 A 4/1986 Hoppin, III et al. ..... 428/546
4,587,700 A 5/1986 Curbishley et al. ..... 29/889.2
4,855,103 A * 8/1989 Ekbom ..... 419/26
4,981,528 A * 1/1991 Fritzemeier et al. ..... 148/562
5,100,050 A 3/1992 Krueger et al. ..... 228/265
5,113,583 A 5/1992 Jenkel et al. ..... 29/889.21
5,517,540 A 5/1996 Marlowe et al. ..... 376/409
5,593,085 A 1/1997 Tohill et al. ..... 228/193
6,210,633 B1 4/2001 Kratt et al. ..... 419/49
6,520,401 B1 2/2003 Miglietti ..... 228/194
6,524,409 B2 2/2003 Barone et al. ..... 148/549
6,619,537 B1 9/2003 Zhang et al. ..... 228/194
6,720,086 B1 4/2004 Strutt ..... 428/593

OTHER PUBLICATIONS

Kratt et al., "Technology of HIPing complex shape parts", Hot isostatic Pressing—Theory and Application,Proceeding of the third International Conference,pp. 259-265 Japan, Tokio Jun. 1991.

* cited by examiner

*Primary Examiner*—Roy King
*Assistant Examiner*—Ngoclan T Mai

(57) ABSTRACT

Method and system for manufacturing multi-component complex shape parts consisting of monolithic and powder materials working at different performance conditions based on hot isostatic pressing of the monolithic elements and powder material including preliminary heat treatment of the said monolithic elements of the multi-component part wherein they are a subject to high temperature solution treatment at elevated isostatic gas pressure followed by quenching in order to homogenize their material, to dissolve residual cast eutectic and to provide the micro-structure and the properties insensitive and steady during the subsequent HIP and heat treatment of the powder material.

4 Claims, 6 Drawing Sheets

METHOD AND SYSTEM FOR MANUFACTURING OF MULTI-COMPONENT COMPLEX SHAPE PARTS CONSISTING OF MONOLITHIC AND POWDER MATERIALS WORKING AT DIFFERENT PERFORMANCE CONDITIONS

FIELD OF THE INVENTION

The present invention relates to a method and apparatus for producing State-of-the-Art Multi-Component parts by Powder Metallurgy technique, and more particularly, by Hot Isostatic Pressing (HIP).

BACKGROUND OF THE INVENTION

There are well known patents disclosing methods and systems for creation of complex shape parts using powder metallurgy techniques.

U.S. Pat. No. 4,529,452 to Walker describes a process for fabricating multi-alloy components such as a turbine disk, made from a metal or metal alloy which has been processed to display super plastic properties at elevated temperatures, is diffusion bonded to a component or components, such as turbine blades, made from another metal or metal alloy, by disposing the components in a press with the surfaces to be bonded in mating contact. Moisture and oxygen are removed from between the surfaces. Heat and pressure are then applied, such as by forging at an elevated temperature or by hot isostatic pressing, to cause super plastic deformation of at least one of the components at the bonding surfaces. The heat and pressure are held sufficiently long to diffusion bond the surfaces. The new integral assembly is then heat treated to obtain desired properties.

U.S. Pat. No. 4,581,300 to Hoppin, et al. discloses a method of a dual alloy turbine wheel manufacture of a cast integral blade ring pressure-sealed to a wrought alloy hub and thereafter bonded thereto by hot isostatic pressing.

U.S. Pat. No. 4,587,700 to Curbishley, et al. also discloses a method, where a dual alloy cooled turbine is manufactured by casting a hollow cylinder of first nickel-base alloy material with high creep resistance to produce directionally oriented grain boundaries. A preform of a second nickel-base alloy material with high tensile strength and high low-cycle-fatigue strength is diffusion bonded into the bore of the hollow cylinder by subjecting the cylinder and preform to hot isostatic pressing. The resulting cylindrical block is cut into thin precisely flat wafers. A plurality of alignable holes for forming fluid cooling passages are photo chemically etched into the individual wafers. The wafers then are laminated by vacuum diffusion bonding techniques, with the holes aligned to form fluid cooling passages. The resulting laminated block is machined to produce the turbine wheel with turbine blades through which the cooling passages extend.

U.S. Pat. No. 5,100,050 to Krueger, et al. discloses an article of manufacture duel alloy turbine disks having at least a first and a second part, each part having different mechanical properties, compositions, microstructures or combinations thereof, being joined together using a forging process to yield a substantially defect-free joint region. The article in the form of a turbine disk is particularly suited for use in a gas turbine engine in which the hub or inner portion must be resistant to low cycle fatigue and have high strength, while the rim or outer portion must be resistant to stress rupture failure and creep failure.

"Hot isostatic Pressing—Theory and Applications" Proceeding of the 3rd International Conference, pp 259-265, Kratt et al. describes technology of HIPing complex shape parts with dual chemical composition and properties from metal powders.

U.S. Pat. No. 5,113,583 to Jenkel, et al. discloses a method of integrally bladed rotor fabrication, in which deformable hollow single crystal blades are protected from deformation during diffusion bonding to the disk by encapsulation in a ceramic protective shell. The ceramic shell serves to occupy the areas between the blades and the surrounding forging die set, so that during application of high temperatures and pressures, damage to the blades is prevented without the use of complex segmented die assemblies.

U.S. Pat. No. 5,517,540 to Marlowe, et al. discloses two step process for bonding the elements of a three-layer cladding tube in which a method is provided for preparing a cladding tube having an outer substrate, an intermediate zirconium barrier layer, and an inner liner. The method includes the following steps: (a) bonding an inner liner alloy sheath exterior circumferential surface to a zirconium sheath interior circumferential surface to form a barrier/inner liner sheath, and (b) bonding the exterior surface of the zirconium sheath on the barrier/inner liner sheath to the interior circumferential surface of an outer substrate alloy tube to form the cladding tube. Alternatively, the method includes the following steps: (a) bonding the zirconium sheath exterior circumferential surface to the outer substrate alloy tube interior circumferential surface to form a substrate tube/barrier sheath, and (b) bonding the exterior circumferential surface of the inner liner alloy sheath to the interior circumferential surface of the zirconium sheath of the substrate tube/barrier sheath to form said cladding tube. In either approach the tube produced by step (a) is heat treated before step (b) is performed. The bonding steps are performed by extrusion and sometimes hot isostatic pressing.

U.S. Pat. No. 5,593,085 to Tohill, et al. discloses a method of manufacturing of impeller assembly, where two articles is sealed together to define a cavity there between. A vacuum is drawn in the cavity by means of an evacuation tube having a passageway. The passageway is then sealed and the articles are subjected to a temperature and pressure to diffusion bond the articles together. A successful diffusion bond can be determined if the evacuation tube sidewall is collapsed.

U.S. Pat. No. 6,210,633 to Kratt, et.al offers a novel method of manufacturing articles of a complex shape by subjecting powder material to Hot Isostatic Pressing. The method involves manufacturing a capsule with at least one insert. The capsule is filled with outgassed powder. Thereafter, the powder in the capsule is subjected to hot isostatic pressing. The capsule is removed to produce a finished article, such as a bladed disk. The thickness of capsule walls is made variable so as to provide substantially unidirectional axial deformation of the powder during the Hot Isostatic Pressing.

U.S. Pat. No. 6,520,401 to Miglietti discloses a process for diffusion bonding of cracks and other gaps in high-temperature nickel and cobalt alloy components. The gap is filled with alloy powder matching the substrate alloy, or with an alloy of superior properties, such as MAR-M 247, MAR-M 247LC, or CM 247LC. A braze containing a melting point depressant is either mixed into the alloy powder or applied over it. The depressant is preferably hafnium, zirconium, or low boron. The component is heated for 15-45 minutes above the melting point of the braze, which fills the spaces between the alloy powder particles. The component is diffused at a temperature above or below the liquidus of the braze and solution heat-treated and aged at a temperature at which the braze and alloy mixture in the gap is solid, but the depressant diffuses away.

U.S. Pat. No. 6,619,537 to Zhang, et al. discloses diffusion bonding of copper sputtering targets to backing plates using nickel alloy interlayears. A sputter target assembly including a high purity copper sputter target diffusion bonded to a backing plate, preferably composed of either aluminum, aluminum alloy, aluminum matrix composite materials, copper, or copper alloy, and a Ni-alloy interlayer, preferably composed of Ni—V, Ni—Ti, Ni—Cr, or Ni—Si, located between and joining the target and backing plate, and a method for making the assembly. The method of making involves depositing (e.g., electroplating, sputtering, plasma spraying) the interlayer on a mating surface of either the sputter target or backing plate and pressing, such as hot isostatically pressing, the sputter target and backing plate together along mating surfaces so as to form a diffusion bonded sputter target assembly.

U.S. Pat. No. 6,524,409 to Barone, et al. discloses a method of producing light alloy castings by foundry technology in which, after solidification and shake-out, the casting is subjected to a heat-treatment cycle comprising a solution heat-treatment step at a temperature high enough to put into solution the phases precipitated in the course of the solidification of the casting, possibly followed by a quenching step and an ageing step, wherein the solution heat-treatment step is performed at least partially in hot isostatic pressing conditions.

U.S. Pat. No. 6,720,086 to Strutt discloses liquid interface diffusion bonding of nickel-based superalloys as comprises a metal honeycomb core such as a nickel-alloy honeycomb core and a nickel-alloy facing sheet bonded thereto. The composition and method of this invention are useful in applications where high strength, heat resistant materials are required, such as in aircraft and aerospace-related structures. The composition is prepared by a method comprising: (a) providing a nickel-alloy honeycomb core having a mating surface and a nickel-alloy facing sheet having a mating surface; (b) placing together the honeycomb core mating surface and the facing sheet mating surface, and providing there between a metal foil comprising nickel, zirconium, and at least one additional metal selected from the group consisting of titanium, niobium, and chromium; (c) subjecting the mating surfaces and metal foil there between to sufficient positive pressure to maintain position and alignment for joining; and (d) heating the mating surfaces and metal foil there between in a protective atmosphere for at least 2 hours to a temperature sufficient to cause melting between the metal foil and mating surfaces of the facing sheet and honeycomb core.

The methods and systems disclosed in Patents and publication mentioned above show that configuration and production routes for bimetallic and sometimes multi-component parts like turbine disks (blisk), impellers, cladded valves and housings are based on diffusion bonding of solid to solid components. Diffusion bonding is usually achieved by hot forging or hot isostatic pressing. There are two goals at least, that should be provided under forging or HIPing:—create bonding of dissimilar materials with tensile strength of the interface area not lower than the strength of a weaker alloy and therefore—provide required properties for integral part.

However traditional heat treatment of solid parts separately or jointly after HIP (forging) following one of the preferred heat treatment regimes cannot provide the level of required properties and microstructure.

As a result all listed above technical solutions do not enable to achieve the goal of a robust manufacturing process for multi-component complex shape parts consisting of different materials including powder material and solid materials each of them possessing the properties which are optimal for the performance of the said multi-component part. The reason is that these solutions do not account the deterioration of the properties of the monolithic component during HIP and heat treatment which is usually done in accordance with the regimes of powder material which has to be consolidated to full 100% density and firmly bonded to the solid monolithic material.

The goal of the present invention is to develop methods and systems for manufacturing of multi-component complex shape parts consisting of monolithic and powder materials working at different performance conditions (for example, turbine blisks), and possessing optimal properties so that monolithic and as powder components are not deteriorated as a result of joint processing which is usually done in accordance with the regimes of powder material which has to be consolidated to full 100% density and firmly bonded to the solid monolithic material.

In particular for bimetallic blisks made from monolithic and powder Ni-based superalloys with cast blades and powder hub and rim, the object of the present invention is to provide the method and system for manufacturing such multi-component part with 100% density of the powder material firmly HIP bonded to the monolithic blades without deterioration of the micro-structure and properties of the blades.

SUMMARY

The present invention discloses the method and system for manufacturing of complex shape multi-component pars from powder and solid materials by hot isostatic pressing.

One or more embodiments of the present invention are a method for manufacturing of the multi-component near-net-shape parts being composed of monolithic cast heat-resistant material(s) and powder material, working at different temperature ranges and performance conditions, involving the following steps:

- manufacturing of monolithic elements of the multi-component part
  - manufacturing of a capsule with inserts enabling to hold the said monolithic elements in the position directed by the part design,
  - preliminary heat treatment of the said monolithic elements of the multi-component part,
  - assembling of the capsule with the said monolithic elements and inserts
  - filling the cavity in the said capsule with powder,
  - outgassing and sealing of the capsule,
  - hot isostatic pressing (HIP),
  - removal of the said capsule and inserts,
  - final heat treatment of the said multi-component part.

One and more embodiments of the present invention are a method of preliminary heat treatment of the said monolithic elements of the multi-component part wherein they are a subject to high temperature solution treatment at elevated isostatic gas pressure followed by quenching in order to homogenize their material(s), to dissolve residual cast eutectic and to provide the micro-structure steady constant during the subsequent HIP and heat treatment of the powder material.

One and more embodiments of the present invention are systems of manufacturing complex near-net-shape multi-component parts by HIP including:

- said monolithic elements made from the material with higher creep resistance compared to the said powder material
- means to control the deformation of the said monolithic elements and the said powder material during densification under hot isostatic pressure in the form of a vacuum tight capsule having the outer shape of the said multi-component part and dimensions accounting deformation during HIP densification of powder powder completely filling the cavity formed in the said capsule with the said monolithic elements assembled with the said inserts and constituting after HIP the powder elements of the said multi-component part.

means to control the dimensions and shape of the capsule and inserts accounting their deformation during HIP densification of powder and providing the final position of the said monolithic elements in the said multi-component part and final dimensions of the multi-component part means for hot isostatic pressing of the said sealed capsule with powder, monolithic elements and inserts providing full densification of the said powder to 100% density, means to remove the said capsule and said inserts from the said multi-component part after densification providing the final position of the said monolithic elements in the said multi-component part and final dimensions of the multi-component part

DETAILED DESCRIPTION OF THE INVENTION

Figure 1:
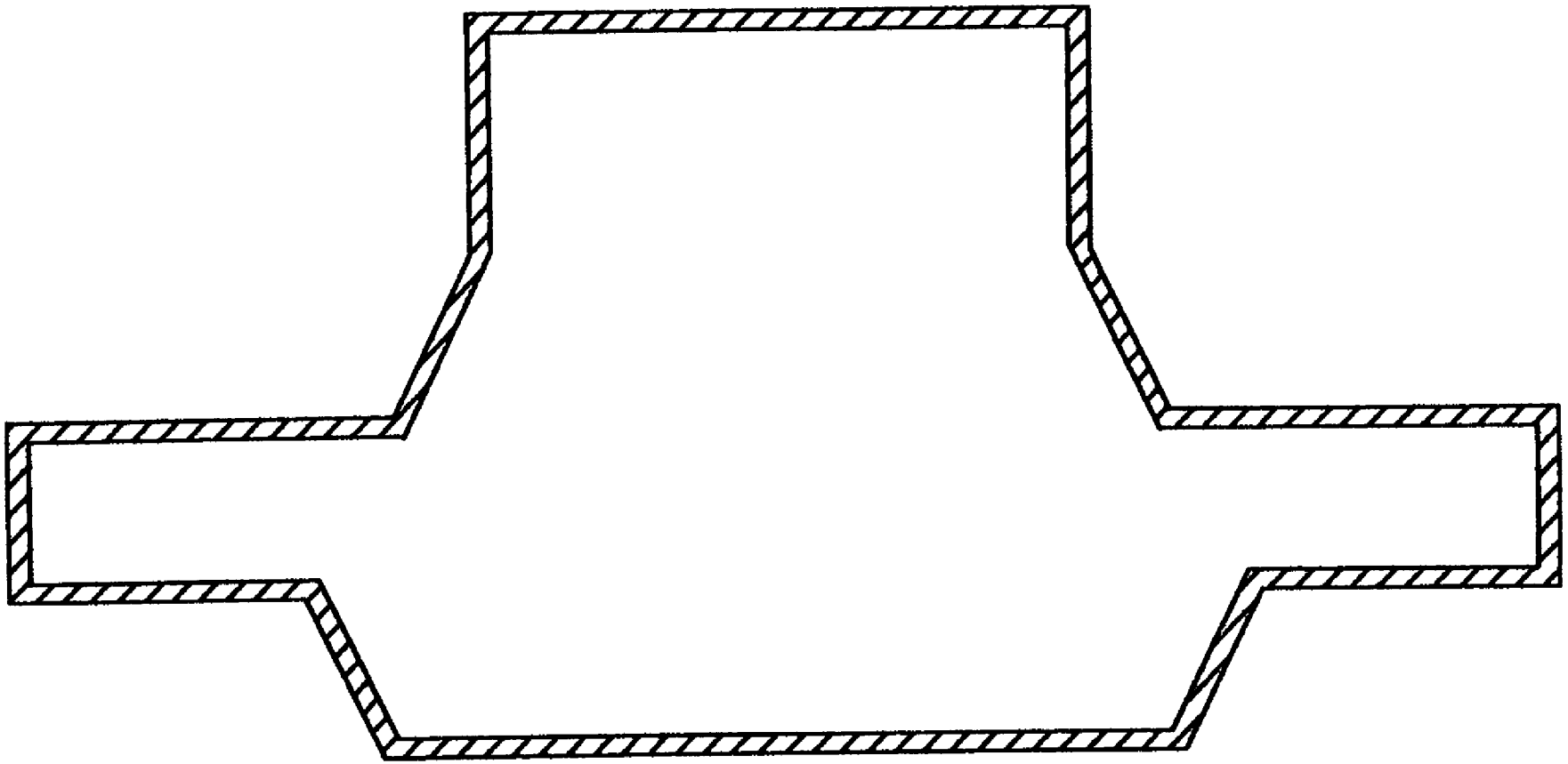
FIG. 1 shows a schematic view of the capsule manufactured from low carbon steel.

The objective of this invention is to develop methods and systems for manufacturing by Hot Isostatic Pressing (HIP) of complex near-net-shape multi-component parts consisting of monolithic elements made from high temperature resistant material and high strength powder material without deterioration of the properties of the monolithic elements during hot densification of powder and subsequent heat treatment of the assembly.

The basis of this method is the research of the behavior of the solid and powder materials under high pressures and temperatures resulting in discovery of the fact that, when HIP of the solid material is performed at a temperature close to its solution temperature, it can achieve more efficient solution of the secondary phases and precipitated eutectic and provide the micro-structure and properties insensitive and steady during the subsequent HIP and heat treatment at lower temperatures typical for the powder material.

Manufacturing of multi-component complex shape parts consisting of monolithic elements made from high temperature resistant material and high strength powder material working at different performance conditions and temperature intervals is based on joint HIP and subsequent heat treatment of solid and powder elements. Such processing is usually accompanied by deterioration of the properties of the solid elements, because HIP and heat treatment parameters are guided by the powder material and can be inappropriate for the solid material.

To solve this problem is necessary to perform preliminary heat treatment of the said monolithic elements of the multi-component part so as the micro-structure and properties become insensitive and steady during the subsequent HIP and heat treatment of the powder material.

As a result the method for manufacturing of multi-component complex shape parts consisting of monolithic elements made from high temperature resistant material and high strength powder material working at different performance conditions and temperature intervals involves the following steps:

manufacturing of monolithic elements of the multi-component part, manufacturing of a capsule with inserts enabling to hold the said monolithic elements in the position directed by the part design, preliminary heat treatment of the said monolithic elements of the multi-component part, assembling of the capsule with the said monolithic elements and inserts filling the cavity in the said capsule with powder, outgassing and sealing of the capsule, hot isostatic pressing (HIP), removal of the said capsule and inserts, final heat treatment of the said multi-component part.

One embodiment of the present invention is a method for producing the preliminary heat treatment of the said monolithic elements of the multi-component part at high isostatic pressure. Application of elevated pressures at the temperatures close to solution temperatures for the solid material facilitates dissolution of the secondary phases and eutectics and provides micro-structure and properties insensitive and steady during the subsequent HIP and heat treatment of the powder material.

The corresponding method consists of preliminary heat treatment of the said monolithic elements of the multi-component part wherein they are a subject to high temperature solution treatment at elevated isostatic gas pressure followed by quenching in order to homogenize their material, to dissolve residual cast eutectic and to provide the micro-structure and the properties insensitive and steady during the subsequent HIP and heat treatment of the powder material.

In the case when monolithic elements of the multi-component part operate at higher temperatures compared to the powder material then monolithic elements of the said multi-component part are manufactured from the material with higher creep resistance compared to the said powder material.

One of the embodiments of the present invention is a method for manufacturing of the bimetallic bladed disks (blisks) with powder hub and rim and cast blades. To realize the proposed method monolithic elements of the said multi-component part are made by investment casting from a superalloy.

The temperature of the said preliminary heat treatment is critically important, as it is a controlling parameter for the dissolution of the said secondary phases to provide stable properties of the solid material during subsequent processing together with the powder material. The said insensitivity to the subsequent HIP and final heat treatment is provided by controlling the temperature of said preliminary heat treatment.

To provide the desired properties of the multi-component part it is necessary that the final heat treatment of the said multi-component part be performed in accordance with the heat treatment regimes for the powder material as it is main condition for the structural performance.

One of the embodiments of the present invention is a method for producing the preliminary heat treatment of the said monolithic elements of the multi-component part at high temperature which exceeds the solution temperature of the solid material to 10-50 C providing its homogenization and insensitivity of the micro-structure and properties to the subsequent HIP and final heat treatment. It has been demonstrated experimentally that high isostatic pressure in combination with this optimal temperature provides better dissolution of the secondary phase due to the suppression of the effects based on the phase transformation and corresponding elementary volume changes.

One of the embodiments of the present invention is a method wherein the said multi-component parts are bladed disks (blisks) with powder hub and rim and cast blades with higher creep resistance compared to the said powder material.

During HIP at high temperatures any cavity in the part consisting of solid and powder elements collapses under such high pressures. In order to manufacture the said bladed disks it is necessary to assemble the said monolithic elements in the capsule for HIP alternating with the inserts so that they form a solid ring.

Powder materials require optimal HIP temperatures which are lower than solution temperatures for the solid elements with higher creep resistance compared to the said powder materials. Therefore the temperature of the said preliminary heat treatment for the solid elements should exceed the HIP temperature of the powder material. It has been demonstrated experimentally that the optimal temperature of this preliminary heat treatment is higher than the HIP temperature of the powder material to 50-150 C.

The time (duration) of the said preliminary heat treatment is also critically important as a controlling parameter for the dissolution of the said secondary phases to provide stable properties of the solid material during subsequent processing together with powder material because all these processes are of diffusion nature. The said insensitivity to the subsequent HIP and final heat treatment is provided by controlling the time of said preliminary heat treatment in order to homogenize their material and to dissolve residual cast eutectic. It has been demonstrated experimentally that the optimal time of the said high temperature solution treatment of the solid material is in the interval of 2-5 hours providing its homogenization and insensitivity of the micro-structure and properties to the subsequent HIP and final heat treatment.

HIP pressure during the said preliminary heat treatment is also an important parameter as it provides better homogenization and dissolution of the residual cast eutectics because of the elementary volume changes during such transformation. Depending on the value of the isostatic pressure the rate and completeness of these dissolution processes differ. Therefore the said insensitivity of the solid material to the subsequent HIP of powder material and final heat treatment is provided by controlling the pressure of the preliminary heat treatment It has been proved experimentally that the optimal value of the isostatic pressure applied during preliminary heat treatment to provide insensitivity of the micro-structure and properties to the subsequent HIP and final heat treatment of the powder material is in the interval of 20-40 Ksi enabling as a result to homogenize the monolithic material and to dissolve residual cast eutectic.

To realize the proposed method, the system for manufacturing of the said multi-component parts consisting of monolithic elements from high temperature resistant material and high strength powder material working in different performance conditions and temperature intervals then includes said monolithic elements made from the material with higher creep resistance compared to the said powder material means to control the deformation of the said monolithic elements and the said powder material during densification under hot isostatic pressure in the form of a vacuum tight capsule having the outer shape of the said multi-component part and dimensions accounting deformation during HIP densification of powder means or more specifically inserts filling the space between the monolithic elements in the said capsule to control the dimensions and shape of monolithic elements of the said multi-component part so that they provide after HIP deformation final dimensions of the said multi-component part powder which completely fills the cavity formed in the said capsule with the said monolithic elements assembled with the said inserts and constituting after HIP the powder elements of the said multi-component part.

means to control the structure and properties of the monolithic elements by solution treatment at high isostatic pressure in order to homogenize their material, to dissolve residual cast eutectic and to provide the microstructure and the properties insensitive and steady during the subsequent HIP and heat treatment of the powder material.

means to control the dimensions and shape of the capsule and inserts accounting their deformation during HIP densification of powder and providing the final position of the said monolithic elements in the said multi-component part and final dimensions of the multi-component part means to control the shape and position of the said monolithic elements assembled in the capsule together with the said inserts filling the intervals between the monolithic elements.

means to control filling of the said capsule with powder and the tap density of the said powder accounting their deformation during HIP densification of powder and providing the final position of the said monolithic elements in the said multi-component part and final dimensions of the multi-component part means to evacuate, out-gas and seal the said capsule with powder, monolithic elements and inserts so that vacuum better than 1 mtorr is reached inside the capsule and is kept during hot isostatic pressing providing firm bonding of powder with the monolithic elements and full densification of powder to 100% density the said during hot isostatic pressing means for hot isostatic pressing of the said sealed capsule with powder, monolithic elements and inserts providing full densification of the said powder to 100% density, means to remove the said capsule and said inserts from the said multi-component part after densification providing the final position of the said monolithic elements in the said multi-component part and final dimensions of the multi-component part means to control the heat treatment of the powder material providing no surface reaction or geometrical distortion of the said monolithic elements in the said multi-component part.

Wherein the said part is a bladed turbine disk (blisk) the hub and shroud are made of the powder material and the said monolithic elements are blades made from the material with higher creep resistance compared to the said powder material. To avoid collapsing during HIP and to provide the desired shape of the blades after HIP consolidation of the powder material and subsequent heat treatment of the said blisks the said monolithic elements are assembled in the capsule alternating with the inserts so that they form a solid ring. During filling and HIP of the said blisks the said powder fills the cavity of the said ring to form the hub and the cavity between the ring and the capsule to form the rim.

EXAMPLES

The example relates to the method and system for manufacturing by HIP of multi-component complex shape parts consisting from solid (monolithic) and powder components (materials) working in different performance conditions so that monolithic and powder components not deteriorated as a result of joint processing which is usually performed in accordance with the regimes of powder material which has to be consolidated to full 100% density and firmly bonded to the monolithic (solid) material.

The first example relates to traditional processing of blisks via HIP.

A capsule (FIG. 1) was designed and manufactured from a low carbon steel sheet with a shape providing after HIP consolidation the final dimensions of the blisk.

Figure 2:
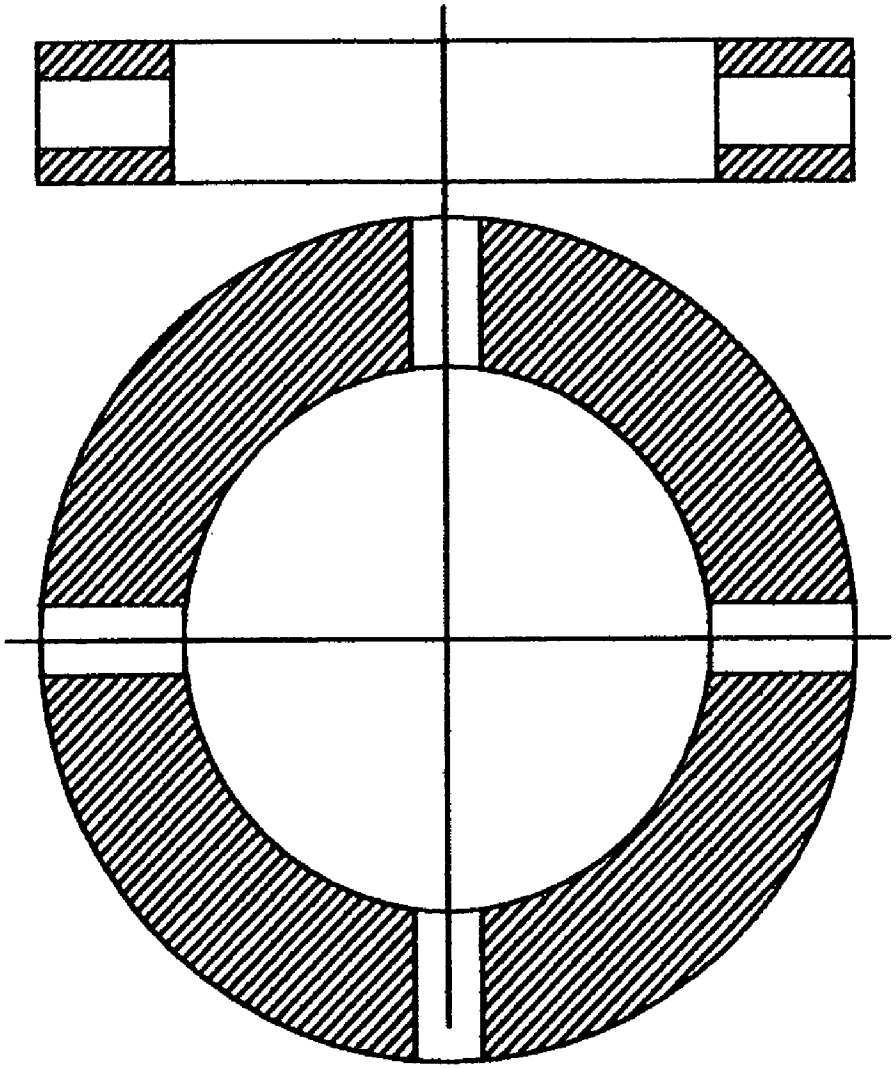
FIG. 2 shows a schematic view of the insert ring from low carbon steel with gaps having the shape and dimensions of the blades.

Inserts having the shape of blades were manufactured by investment casting from low carbon steel and assembled in form of a ring (FIG. 2) with the gaps having the shape and dimensions of the blades.

Figure 3:
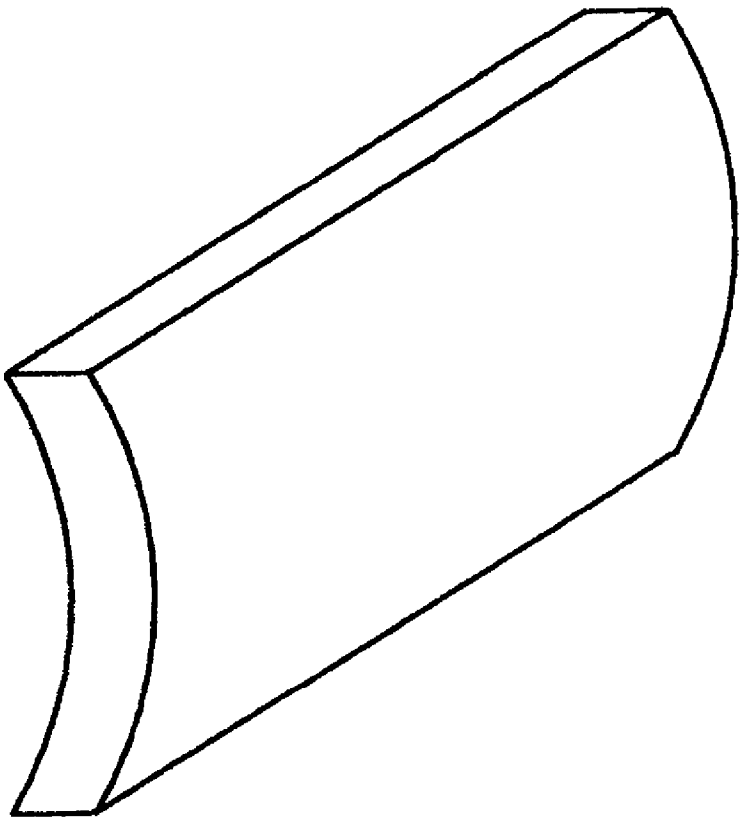
FIG. 3 shows a schematic view of monolithic (cast) elements from a heat-resistant alloy.

The blades for the blisk (FIG. 3) were cast from a high temperature Ni-based superalloy MARM-247.

Figure 5:
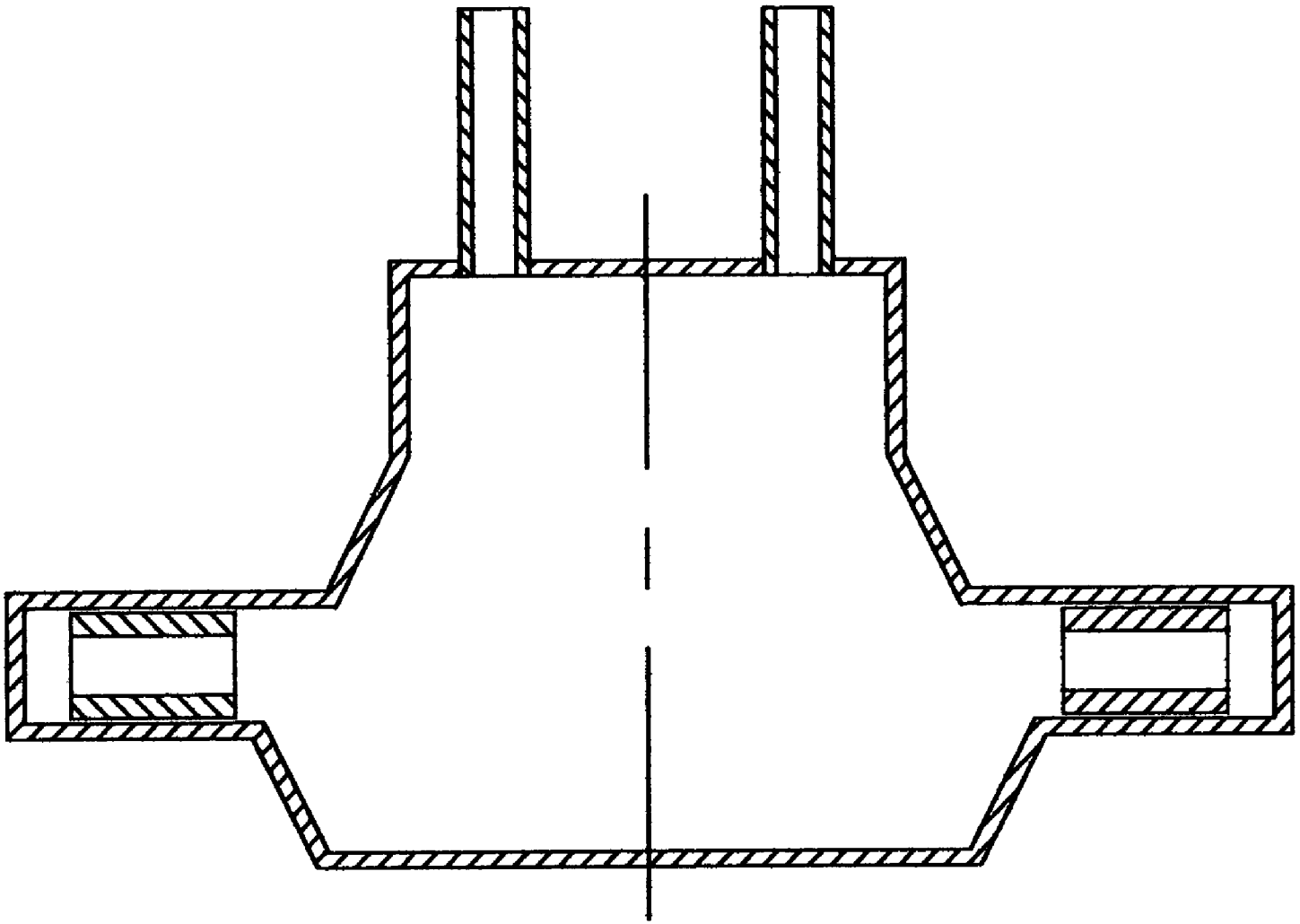
FIG. 5 shows a schematic view of filling the capsule by powder and hot outgassing.

Then inserts and blades were assembled in the capsule and the said capsule was filled with Rene95 powder, hot out-gassed and vacuum sealed (FIG. 5).

Figure 6:
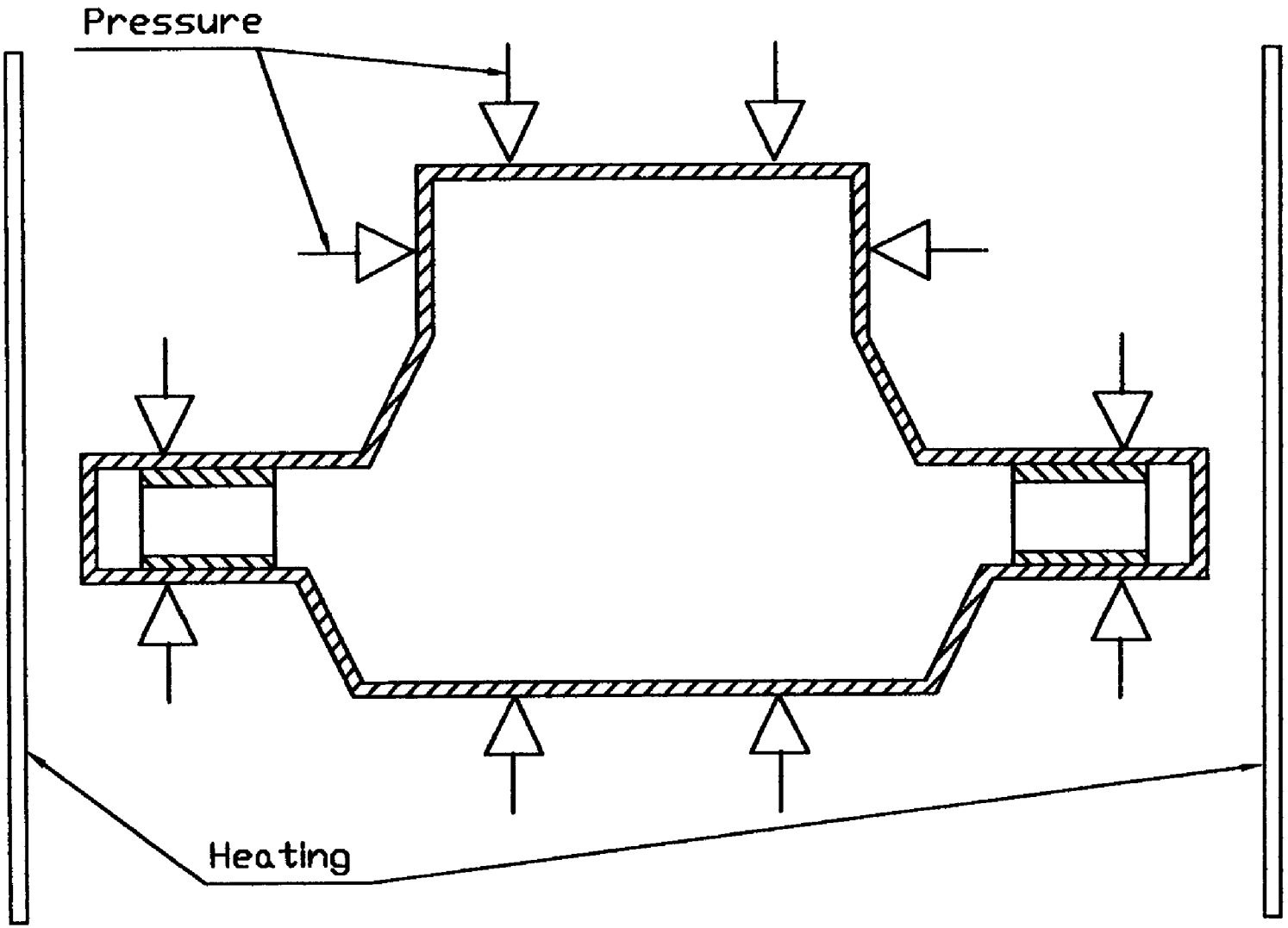
FIG. 6 shows a schematic view of Hot Isostatic Pressing.

Hot isostatic pressing of the capsule with powder was done at 1120 C and 25 Ksi during 4 hours to provide consolidation of the powder material to 100% density and its firm bonding with the cast blades (FIG. 6).

The capsule and inserts were then removed from the multi-component part by pickling in Nitric acid so that the low carbon steel capsule and inserts were dissolved without attacking the consolidated powder and cast blades. After that the final heat treatment providing the required level of strength and ductility for the powder material was done including solution annealing during 5 hours and air quenching from 1120 C and ageing at 760 C during 24 hours followed by air quenching.

As a result the blades had the level of properties below the specification deteriorated during HIP and heat treatment of the powder material:

| | UTS | YS | Elongation, % | Reduction of area, % |
|---|---|---|---|---|
| | 135 Ksi | 120 Ksi | 4.0% | 6.7% |
| | 128 Ksi | 118 Ksi | 3.8% | 5.5% |
| Specification | 160 Ksi | 140 Ksi | 6.0% | 9.0% |

The Second example relates to the proposed method and system.

The method and system were realized in the following way:

The capsule (FIG. 1) was designed and manufactured from a low carbon steel sheet with a shape providing after HIP consolidation the final dimensions of the blisk.

Inserts having the shape of blades were manufactured by investment casting from low carbon steel and assembled in form of a ring (FIG. 2) with the gaps having the shape and dimensions of the blades.

Figure 4:
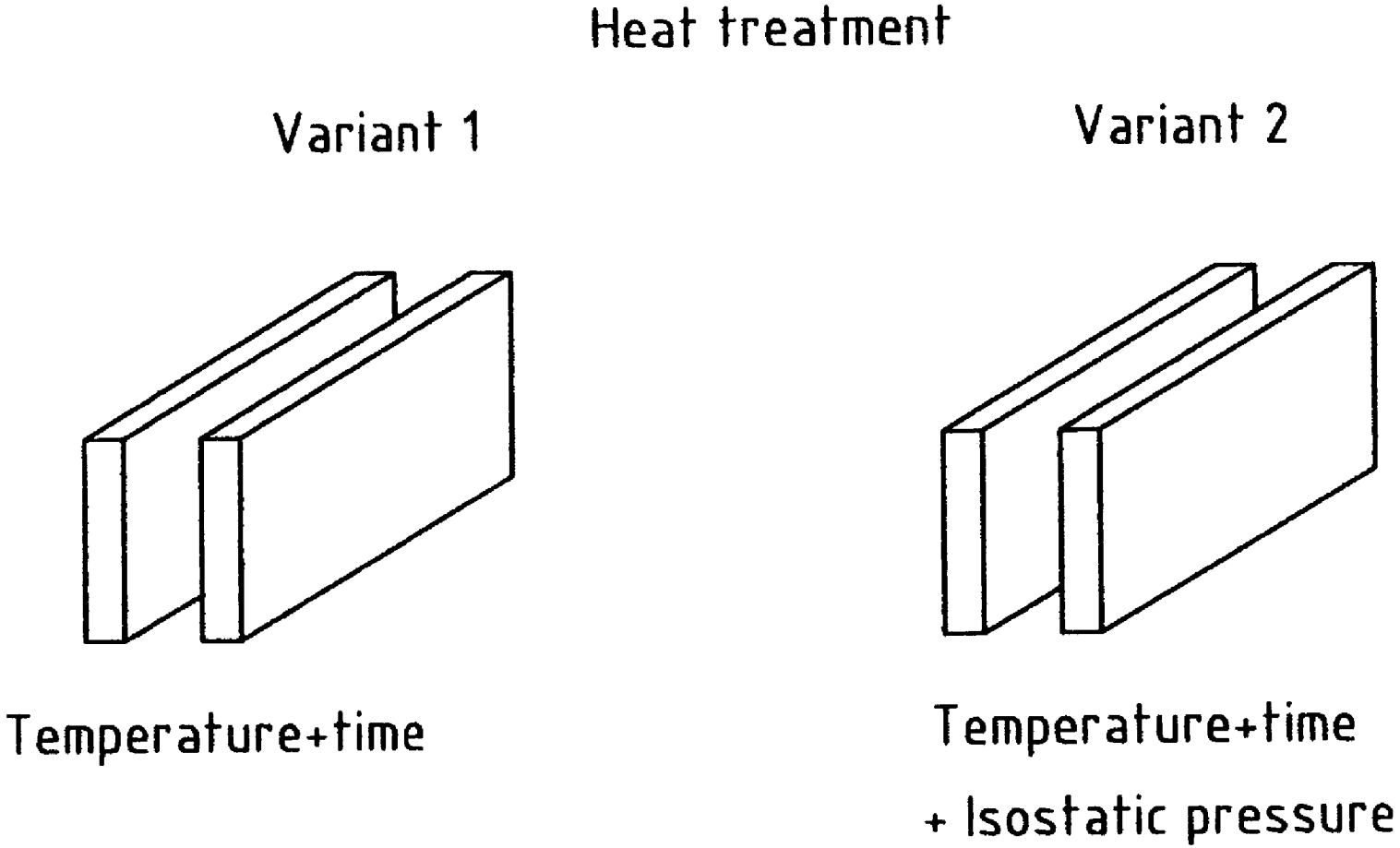
FIG. 4 shows a schematic view of preliminary heat treatment at elevated isostatic pressure.

The blades for the blisk (FIG. 3) were cast from a high temperature Ni-based superalloy MARM-247. Then the blades were subjected to high temperature solution treatment under high temperature of 1230 C and isostatic pressure of 30 Ksi during 2 hours and then quenched from 1230 C to provide homogenized micro-structure and high strength (FIG. 4).

After that inserts and blades were assembled in the capsule and the said capsule was filled with Rene95 powder, hot out-gassed and vacuum sealed (FIG. 5).

Hot isostatic pressing of the capsule with powder was done at 1120 C and 25 Ksi during 4 hours to provide consolidation of the powder material to 100% density and its firm bonding with the cast blades (FIG. 6).

The capsule and inserts were removed from the multi-component part by pickling in Nitric acid So that the low carbon steel capsule and inserts were dissolved without attacking the consolidated powder and cast blades. After that the final heat treatment providing the required level of strength and ductility for the powder material was done including solution annealing during 5 hours and air quenching from 1120 C and ageing at 760 C during 24 hours followed by air quenching.

As a result of the application of the proposed method and system the blades had the following high level of properties not deteriorated during HIP and heat treatment of the powder material:

| | UTS | YS | Elongation, % | Reduction of area, % |
|---|---|---|---|---|
| | 175 Ksi | 150 Ksi | 6.3% | 9.7% |
| | 186 Ksi | 144 Ksi | 10.8% | 13.5% |
| Specification | 160 Ksi | 140 Ksi | 6.0% | 9.0% |

We claim:

1. A method for manufacturing of multi-component complex shape parts consisting of monolithic elements made from high temperature resistant material and high strength powder material wherein the said monolithic elements of the multi-component part are pre-HIPed at elevated pressure and temperature, wherein the temperature of the pre-Hot Isostatic Pressing (HIP) exceeds the solution temperature of the material of the said monolithic elements to 10-50 degrees C., so that to provide homogenization of the material of the said monolithic elements, dissolution of residual cast eutectic.

2. A method for manufacturing of multi-component complex shape parts consisting of monolithic elements made from high temperature resistant material and high strength powder material operating at different performance conditions and temperature intervals, comprising a two-step process of HIP wherein during the first Step the said monolithic elements of the multi-component part are HiPed at elevated pressure and temperature, wherein the temperature of the first Step HIP exceeds the solution temperature for the powder material 50-100 C so that to provide homogenization of the material of the said monolithic elements, dissolution of residual cast eutectic and insensitivity to the subsequent second Step HIP and heat treatment of the powder material.

3. A method in accordance with claim 2 wherein the temperature of the first Step HIP exceeds the temperature of the second Step HIP for the powder material to 50-150 degrees C.

4. A method in accordance with claim 2 wherein the optimal value of the HIP pressure applied during the first Step HIP is in the interval of 20-40 Ksi.

* * * * *